US006820905B1

(12) United States Patent
Haeck et al.

(10) Patent No.: US 6,820,905 B1
(45) Date of Patent: Nov. 23, 2004

(54) VERTICAL PANIC EXIT DEVICE

(75) Inventors: Paul J. Haeck, Carmel, IN (US); Raymond W. Peeler, Westfield, IN (US); Greg Drake, New Braunfels, TX (US); Albert E. Ranzau, III, Leon Valley, TX (US)

(73) Assignee: Detex Corporation, New Braunfels, TX (US)

( * ) Notice: Subject to any disclaimer, the term of this patent is extended or adjusted under 35 U.S.C. 154(b) by 317 days.

(21) Appl. No.: 09/626,542

(22) Filed: Jul. 26, 2000

(51) Int. Cl.[7] ..... E05B 65/10

(52) U.S. Cl. ..... 292/93; 292/223; 292/DIG. 65; 70/92

(58) Field of Search ..... 292/92, 222, 223, 292/DIG. 65, DIG. 24; 70/92

(56) References Cited

U.S. PATENT DOCUMENTS

| | | | | | |
|---|---|---|---|---|---|
| 1,708,078 | A | * | 4/1929 | Bolles | 292/92 |
| 3,029,096 | A | * | 4/1962 | Welch | 292/92 |
| 3,124,378 | A | * | 3/1964 | Jackson | 292/92 |
| 3,319,986 | A | * | 5/1967 | Balducci | 292/92 |
| 3,563,585 | A | * | 2/1971 | Welch | 292/92 |
| 3,767,238 | A | | 10/1973 | Zawadzki et al. | |
| 3,776,582 | A | * | 12/1973 | Balducci | 292/92 |
| 3,788,687 | A | * | 1/1974 | Zawadzki | 292/92 |
| 3,854,763 | A | | 12/1974 | Zawadzki et al. | |
| 4,167,280 | A | | 9/1979 | Godec et al. | |
| 4,427,223 | A | | 1/1984 | Godec et al. | |
| 4,466,643 | A | | 8/1984 | Godec et al. | |
| 4,601,499 | A | * | 7/1986 | Kim | 292/36 |
| 4,741,563 | A | | 5/1988 | Cohrs | |
| 4,961,330 | A | * | 10/1990 | Evans | 292/92 |
| 5,169,185 | A | * | 12/1992 | Slaybaugh et al. | 292/92 |
| 5,464,259 | A | * | 11/1995 | Cohrs et al. | 292/92 |
| 5,702,134 | A | * | 12/1997 | Hsieh | 292/92 |
| 5,816,017 | A | * | 10/1998 | Hunt et al. | 292/92 |
| 6,000,733 | A | * | 12/1999 | Linder | 292/92 |
| 6,009,732 | A | | 1/2000 | Haeck et al. | |

* cited by examiner

*Primary Examiner*—Robert A. Siconolfi
(74) *Attorney, Agent, or Firm*—John G. Fischer; Storm & Hemingway, LLP

(57) ABSTRACT

A vertical panic exit device is interchangeably mountable on either left-hand opening or right-hand opening doors and comprises a latch mechanism for engagement with a strike mounted to a doorjamb to alternately transition a door mounted to the jamb in a latched and unlatched configuration. A central portion includes a push bar; an action rod interlinked to said push bar such that a depression of the push bar causes the action rod to be translated in a direction orthogonal to the push bar, and a center case mechanism movable between a latched and an unlatched position. The center case mechanism comprises a housing, and a main link carriage horizontally slidably mounted within the housing. The main link carriage is linked to and is acted upon by the action rod for translation between the latched and unlatched position. An actuator link has a first end pivotally attached to the main link carriage. A pivoting member is pivotally mounted to the housing and has first and second pivotal attach points. A second end of the actuator link is selectively coupled to one of either the first or second attach points. When the second end of the actuator link is selectively coupled to the first attach point, it configures the center case mechanism for latching and unlatching a right handed opening door, and when selectively coupled to the second attach point, it configures the center case mechanism for latching and unlatching a left handed opening door. A slider is vertically slidably mounted within the housing and is in movable engagement with the pivoting member such that a pivoting motion of the pivoting member causes the slider to slide in a vertical direction. The slider includes at least one attach point for connection with the latch mechanism.

32 Claims, 15 Drawing Sheets

VERTICAL PANIC EXIT DEVICE

BACKGROUND OF TEE INVENTION.

1. Field of the Invention

The invention relates to door hardware, and more particularly to a panic exit device with a panic bar pad actuating mechanism that latches the door at the top and bottom rather than at the side.

2. Description of the Related Art

Panic exit devices are commonly used on doors in public settings. The push pad translates a user's push against a moveable bar into the unlatching of the doors latch mechanism, allowing the pedestrian entry or exit. For example, U.S. Pat. No. 3,614,145 entitled "Dogging Device for Panic Exit Latch and Actuator Assembly," discloses a standard push pad assembly which translates a forward motion of the pad into a lateral motion that withdraws a latch bolt from a strike plate. U.S. patent application Ser. No. 09/056,261, filed Apr. 7, 1998, now U.S. Pat. No. 6,009,732, entitled "Panic Exit Device", describes the related art, and discloses an improved panic exit device that can be used in either a horizontal installation, where the latch interconnects with a strike mounted in the vertical portion of the door frame, or that can be adapted to be used in a vertical installation, wherein the latch and locking rod interconnect with strikes mounted in the door header and in the floor. Improvements upon the standard push pad assembly that are disclosed in the Panic Exit Device patent include an improved latch deadlocking mechanism, an improved latch to pad mechanism, a pad lock down feature, a universal mounting plate and easily mounted strike, and a vertical rod-bottom deadlocking mechanism in the center case of the device. This application discloses further improvements upon the vertical panic exit device disclosed in the Panic Exit Device patent.

SUMMARY OF THE INVENTION

The present invention relates to a panic exit device and fire exit device used on doors in schools, hospitals, public buildings and other commercial buildings. The device comprises a center case mechanism combined with a pad actuating mechanism and a top latch mechanism. The center case mechanism controls the top or bottom actuating rods. The top actuating rod controls the top latching mechanism mounted at the top of the door. The device incorporates several novel features including: (1) a simplified dual deadlocking design; (2) a simplified center case mechanism that is "non-handed," meaning that it can be installed on either a right-hand opening door or a left-hand opening door; and (3) an improved and simplified deadlocking mechanism located at the upper latch rather than in the center case mechanism.

One aspect of the invention is a vertical panic exit device interchangeably mountable on either left-hand opening or right-hand opening doors. The device comprises a latch mechanism for engagement with a strike mounted to a doorjamb alternately transition a door mounted to the jamb in a latched and unlatched configuration. A central portion includes a push bar; an action rod interlinked to said push bar such that a depression of the push bar causes the action rod to be translated in a direction orthogonal to the push bar, and a center case mechanism movable between a latched and an unlatched position. The center case mechanism comprises a housing, and a main link carriage horizontally slidably mounted within the housing. The main link carriage is linked to and is acted upon by the action rod for translation between the latched and unlatched position. An actuator link has a first end pivotally attached to the main 2ink carriage. A pivoting member is pivotally mounted to the housing and has first and second pivotal attach points. A second end of the actuator link is selectively coupled to one of either the first or second attach points. When the second end of the actuator link is selectively coupled to the first attach point, it configures the center case mechanism for latching and unlatching a right handed opening door, and when selectively coupled to the second attach point, it configures the center case mechanism for latching and unlatching a left handed opening door. A slider is vertically slidably mounted within the housing and is in movable engagement with the pivoting member such that a pivoting motion of the pivoting member causes the slider to slide in a vertical direction. The slider includes at least one attach point for connection with the latch mechanism.

Another aspect of the present invention is a center case mechanism for a vertical panic exit device that is operable between a latched and an unlatched position. The center case mechanism comprises a housing and a main link carriage horizontally slidably mounted within the housing. The main link carriage being translatable between the latched and the unlatched positions. An actuator link has a first end pivotally attached to the main link carriage. A pivoting member is pivotally mounted to the housing and has first and second pivotal attach points. A second end of the actuator link is selectively coupled to either one of the first or second attach points. When the second end of the actuator link is selectively coupled to the first attach point it configures the center case mechanism for latching and unlatching a right handed opening door, and when selectively coupled to the second attach point it configures the center case mechanism for latching and unlatching a left handed opening door. A slider is vertically slidably mounted within the housing and is in movable engagement with the pivoting member such that a pivoting motion of the pivoting member causes the slider to slide in a vertical direction. The slider includes at least one attach point for connection with a latch mechanism.

Yet another aspect of the present invention is an upper latching mechanism for a vertical panic exit device. The latching mechanism comprises a housing and a latch pivotally mounted to the housing. The latch is pivotable between an extended latched position for engagement with the doorjamb mounted strike, and a retracted position for opening the door. An actuator rod receptacle is slidably retained in the housing, and a linkage interconnects the latch and the receptacle. The linkage translates an upward movement of the actuator rod receptacle to a downward retracted pivoting of the latch.

These and other advantages of the invention will be further understood and appreciated by those skilled in the art by reference to the following written specification, claims, and appended drawings.

DETAILED DESCRIPTION OF THE INVENTION

Figure 1:
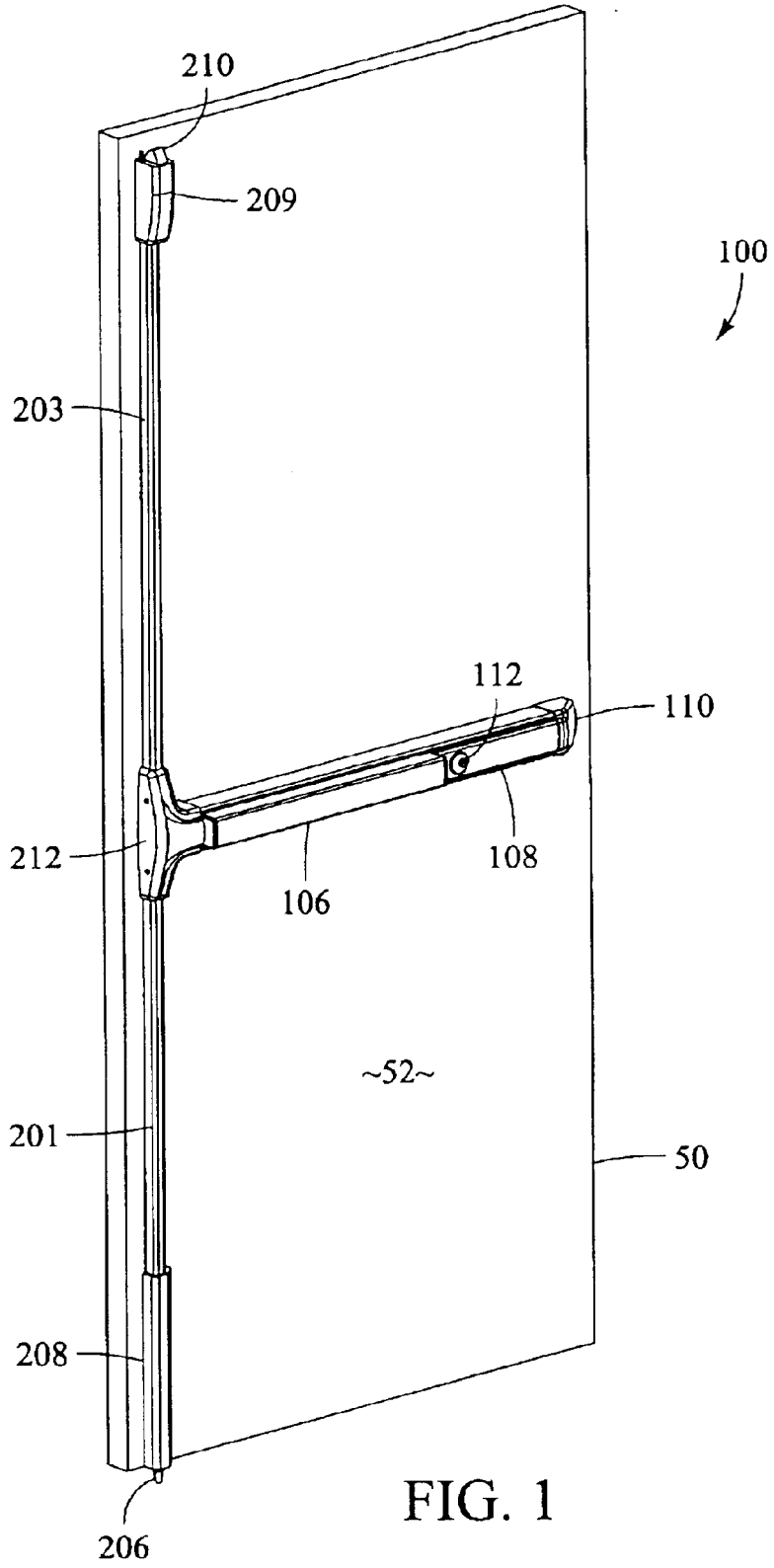
FIG. 1 is a perspective view of a door having mounted thereon a panic exit device embodying the present invention.
Figure 3:
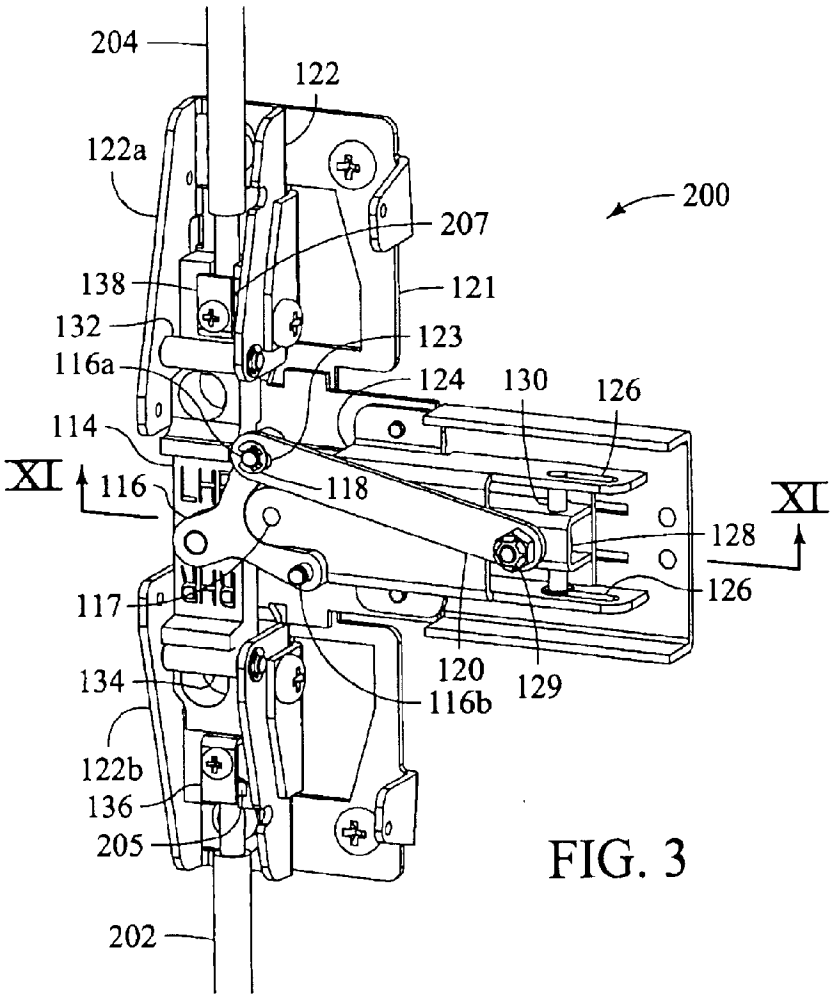
FIG. 3 is a perspective view of center case mechanism.

For purposes of description herein, the terms "upper", "lower", "right", "left", "rear", "front", "vertical", "horizontal", and derivatives thereof shall relate to the invention as oriented in FIGS. 1 and 3. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The vertical panic exit device of the present invention improves upon prior art devices in a several areas. First, it incorporates an improved latch deadlocking design. The center case and the upper latch mechanism both incorporate deadlock features as described below. The deadlock feature of the center case functions as the deadlock feature of the bottom bolt, and as a secondary redundant deadlock of the upper latch mechanism that incorporates its own deadlock feature. However, the top latch deadlock does not function to deadlock the lower bolt. Second, the device includes a simplified center case mechanism that is "non-handed," meaning that it can be installed on either a right-hand opening or a left-hand opening door. Third, the present invention incorporates an improved and simplified fire locking mechanism located at the upper latch, rather than in the center case mechanism. Finally, the improved vertical panic exit device includes an improved lower cover at the bottom of the door. The lower cover provides a gentle transition between the surface of the door and the outer surface of the cover, making the design more compatible with the requirements of the Americans with Disabilities Act (ADA).

FIG. 1 shows the vertical panic exit device 100 of a preferred embodiment as it would appear in use, mounted on a door 50. Although this style of panic exit is used primarily on double doors with a strike in the header and a strike in the floor, only a single door is shown in FIG. 1 for simplicity. A second adjacent door would typically employ a mirror image configuration. A push pad actuator or push bar 106 is shown mounted to the door 50 along with a dogging mechanism 112, case filler 108, and an end cap 10. Dogging mechanism 112 is optional and is not required for operation of the preferred embodiment, and by building codes cannot be included in a fire exit device. A center case mechanism 200 (FIG. 3) under cover 212 is used to translate the motion of the push bar 106 to a pair of vertical actuating rods 202 and 204, located under covers 201 and 203, respectively. Vertical actuating rod 204 controls a latching mechanism 300 (FIG. 14) located under cover 209 and a latch 210. As vertical actuating rod 204 moves upward, latching mechanism 300 operates to translate the upward motion into a retraction of latch 210. Vertical actuating rod 202 controls the vertical translation of a bolt 206 for engagement and disengagement with a corresponding floor aperture (not shown). When push pad actuator 106 is depressed against door 50, vertical actuating rods 202 and 204 and latching mechanism 300 operate cooperatively to retract both bolt 206 and latch 210 so that the door may open freely.

Figure 2:
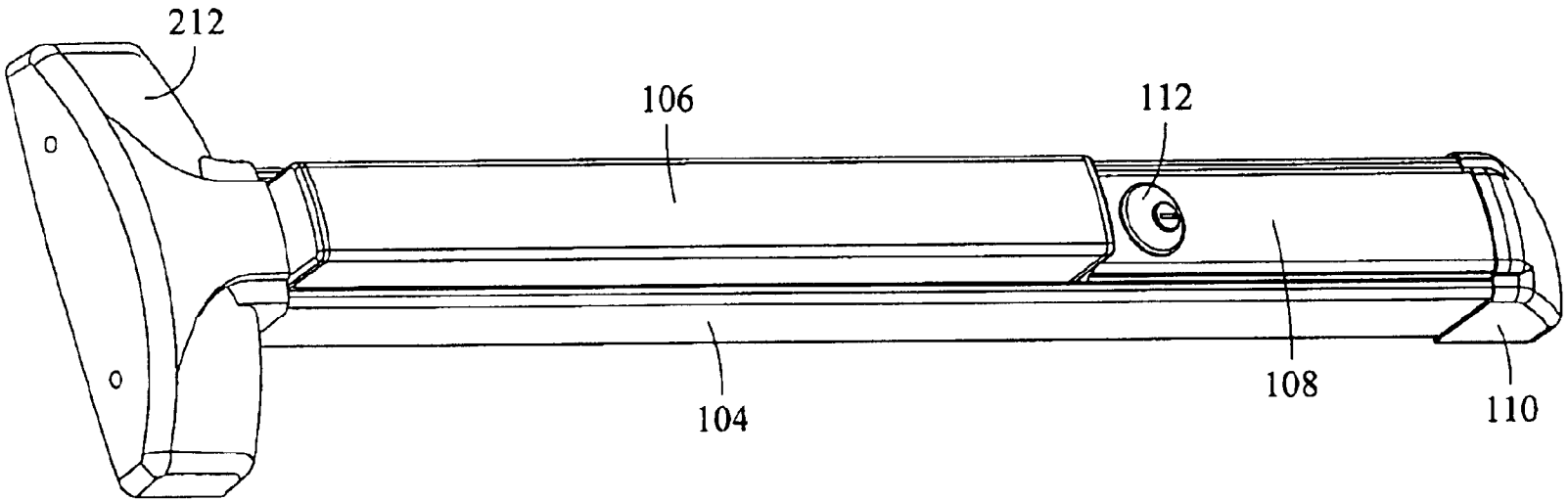
FIG. 2 is a perspective view of the center portion of the vertical panic exit device including the push bar.
Figure 12:
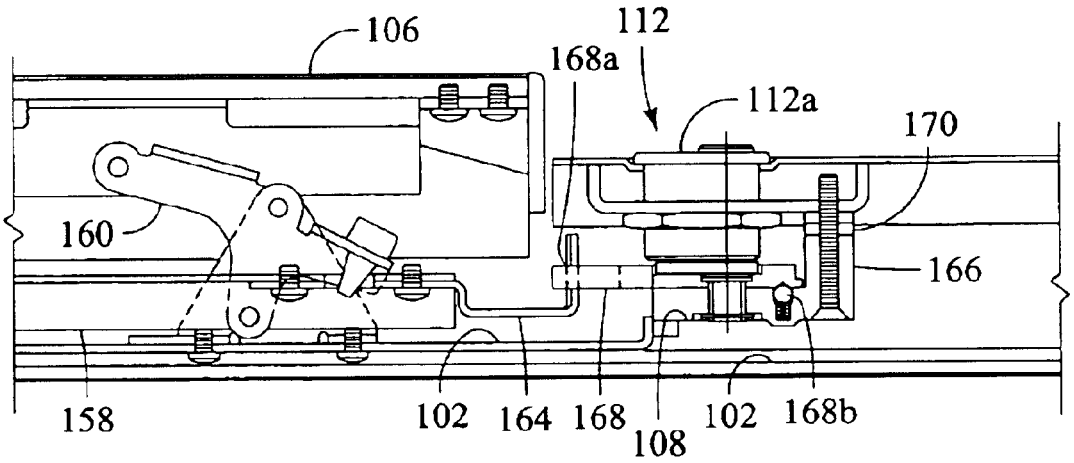
FIG. 12 is a side view showing the dogging mechanism, lock cylinder, bracket, action rod, and hook member.

FIG. 2 shows a perspective view of the center portion of the vertical panic exit device 100. The center portion includes a base plate 102 (FIG. 12) covered by a housing 104. Push pad actuator 106 is captured by the base plate 102 so that it can move between a first, outward position and a second inward or depressed position. The push pad actuator 106 can extend the entire length of the base plate, but in a preferred embodiment, push pad actuator 106 only extends a portion of the length of the base plate 102. A case filler 108 can be used to fill the unused length of the base plate 102. An end cap 110 can be used to prevent any lateral movement of the push pad actuator 106 or case filler 108. The end cap 110 also presents a smoother aesthetically pleasing surface. The case filler 108 can have an opening to accept dogging mechanism 112 which is coupled between the case filler 108 and the push bar 106. As will be discussed in greater detail below, the dogging mechanism 112 is used to lock the push bar in its second, inward, and open position. Finally, center case mechanism 200 (FIG. 3) is housed under cover 212 and is operably engaged with push bar 106.

FIG. 3 is a perspective view of center case mechanism 200. Center case mechanism 200 includes housing 122 which is mounted to mounting bracket 121. Bracket 121 is mounted flush to an inner surface 52 of door 50. Housing 122 includes a main portion and two "arm" portions, designated 122*a* and 122*b* in FIG. 3. Center case mechanism 200 also includes an internal cover 124 which couples to the housing 122 and extends outward from the housing 122. The internal cover 124 couples to and encloses a main link carriage 128, via pin 130 which slides along slots 126. A deadlocking plate 140 (FIG. 7*a*) is captured between the main link carriage 128 and the housing 122. Deadlocking plate 140 is connected to main link carriage 128 such that lateral movement of carriage 128 results in a like lateral movement of plate 140. The main link carriage 128 and deadlocking plate 140 retract in response to the movement of the push pad actuator 106. Details regarding the operation of the main link carriage 128 and the deadlocking plate 140 are provided below.

The main link carriage 128 is coupled to a first end of actuator linkage 120 with a pin and bushing combination 129 thereby permitting the pivotal movement of linkage 120 about pin and bushing 129. The second end of actuator linkage 120 includes a slot 123 that couples actuator linkage 120 to pivoting member 116 at either post 116*a* (as shown in FIG. 3) or post 116*b* and is retained thereon by locking 118. As will be discussed in further detail below, when actuator linkage 120 is coupled to post 116*a* of pivoting member 116, the center case mechanism is set for installation on a right hand opening door. Alternatively, when actuator linkage 120 is coupled to post 116*b* of pivoting member 116, the center case mechanism 200 is set for installation on a left hand opening door. Thus, the center case mechanism 200 is not "handed," in the sense that a left hand design is different from a right hand design. Reconfiguring the "handedness" of center case mechanism 200 is accomplished by switching actuator linkage 120 between posts 116*a* and 116*b* and rotating center case mechanism 200 one-hundred-eighty degrees within its vertical plane. Actuator linkage 120, when properly configured, is on the upper one of posts 116*a* and 116*b*. The individual installing the panic exit device 100 on the door 50 can easily accomplish configuring center case mechanism 200 immediately prior to installation.

Figure 4:
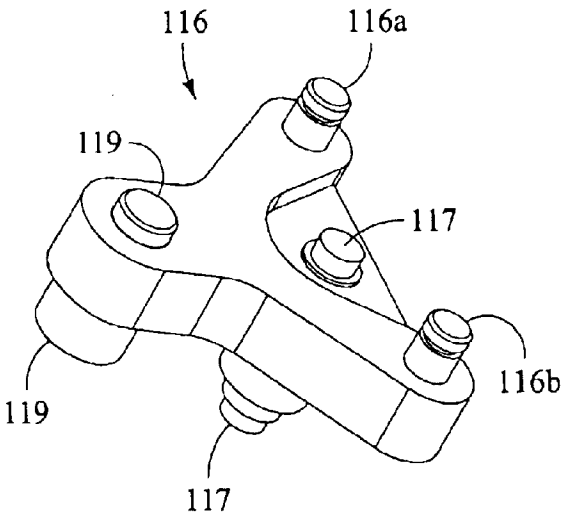
FIG. 4 is a perspective view of the pivoting member within the center case mechanism.

FIG. 4 shows a perspective view of pivoting member 116. As shown in FIG. 4, pivoting member 116 includes posts 116*a* and 116*b*, which couple to actuator linkage 120 as discussed above. Pivoting member 116 also includes pins 117 and 119.

Figure 5A:
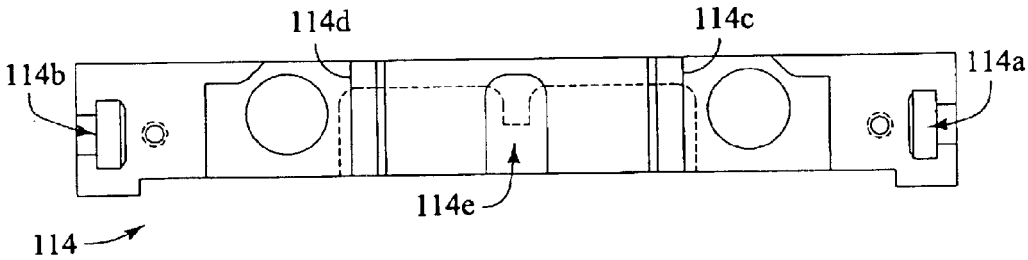
FIGS. 5*a*, 5*b*, and 5*c* show front, side, and rear views of the slider within the center case mechanism.
Figure 5B:
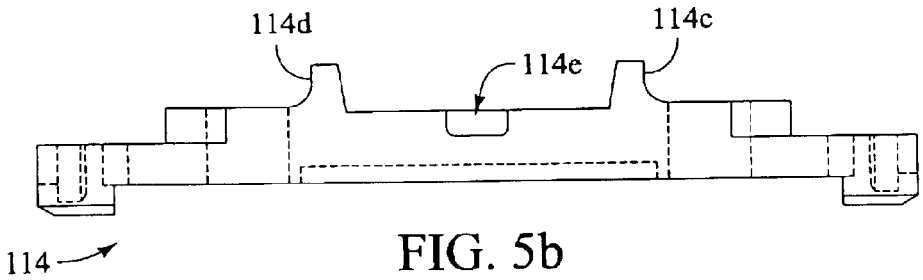
Figure 5C:
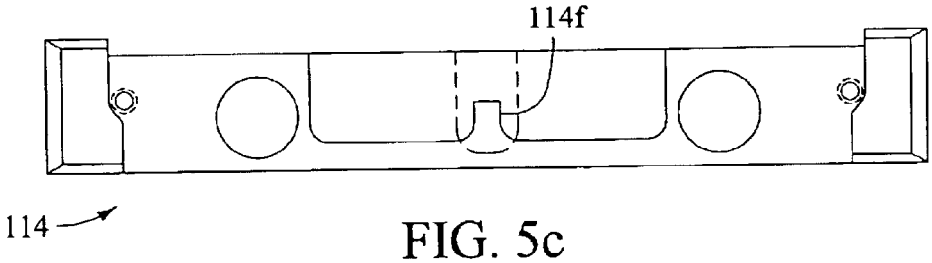

Referring again to FIG. 3, pivoting member 116 pivots about pin 117. Pin 117 also couples pivoting member 116 to internal cover 124. Pin 119 couples to slider 114 by engaging slot 114*e* (FIGS. 5*a* & 5*b*). When main link carriage 128 and actuator linkage 120 move horizontally is response to depression of the push pad actuator 106, pivoting member 116 pivots about pin 117 and pin 119 translates slider 114 in a vertical upward direction, thus translating horizontal motion to vertical motion.

Referring now to FIGS. 3 and 5*a*–5*c*, slider 114 includes cavities 114*a* and 114*b*, which are sized to accept and capture the heads of bolts 205 and 207. Bolts 205 and 207 couple to internally threaded vertical actuating rods 202 and 204, respectively. Bolts 205 and 207 are retained within cavities 114*a* and 114*b* by locking plates 136 and 138 respectively. The range of vertical motion of slider 114 is limited by shoulders 114*c* and 114*d*, which contact stops 132 and 134, respectively, at the outer ranges of allowable motion of slider 114. An intermediate buffer material such as a soft plastic coating or insert can be included to reduce the noise of slider 114 contacting stops 132 and 134. Stops 132 and 134 are retained in housing arms 122*a* and 122*b*, respectively. A deadlocking stop 114*f* is positioned midway along the rear face of slider 114.

Figure 6:
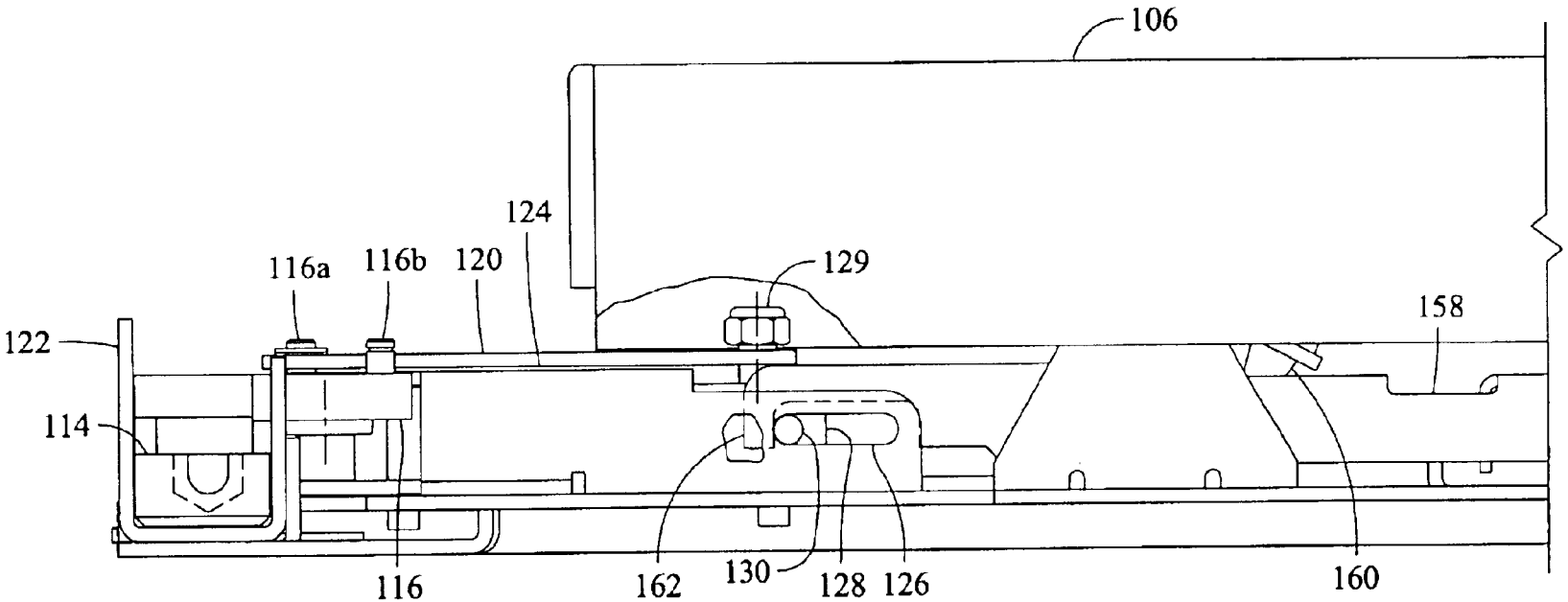
FIG. 6 illustrates the center case to pad mechanism that translates the forward motion of the on of the main link carriage.

FIG. 6 illustrates the mechanism interlining the push bar 106 with center case mechanism 200 that translates the depressive motion of the push bar 106 into the lateral motion of the main link carriage 128. The push bar 106 is connected to an action rod 158 by a rocking mechanism 160. When push bar 106 is depressed toward door 50 rocking mechanism is pivoted about a vertical axis thereby translating the depressive motion applied to the push bar 106 into a lateral movement of the action rod 158. The action bar is coupled to the main link carriage 128 by a hook 162 that engages pin 130.

Figure 7A:
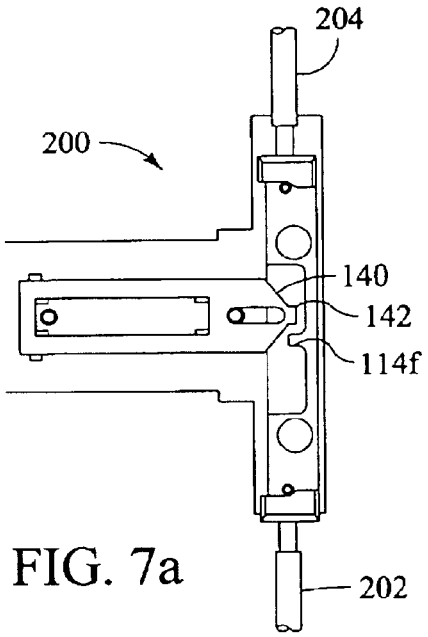
FIGS. 7*a* and 7*b* illustrate the center case mechanism from the rear and front respectively, showing the panic exit device in a closed and latched position.
Figure 7B:
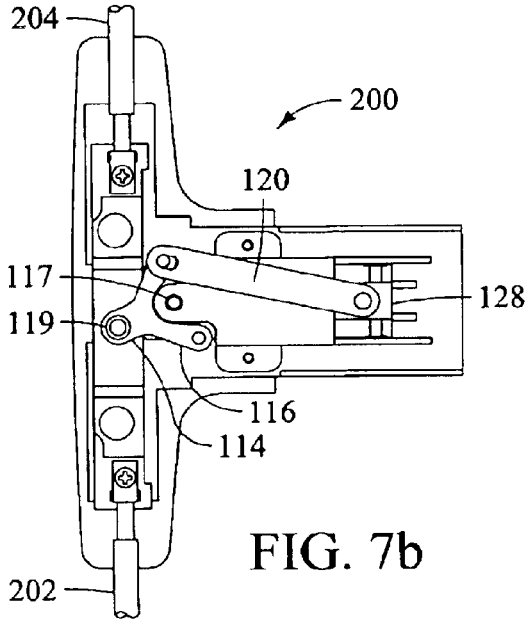
Figure 11:
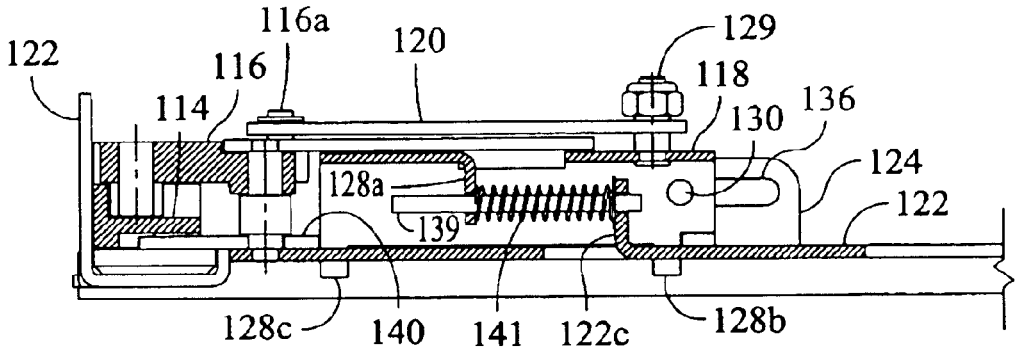
FIG. 11 shows a sectional view of the center case mechanism taken along line XI—XI of FIG. 3 showing the main link carriage and its interface with the housing and the deadlocking plate.

FIG.11 shows a cutaway view of the center case mechanism 200 showing main link carriage 128 and its interface with the housing 122 and the deadlocking plate 140. As shown in FIG. 11, housing 122 includes flange 122*c*, and main link carriage 128 includes flange 128*a* and two pairs of tabs, designated as 128*b* (first pair) and 128*c* (second pair). Tabs 128*b* and 128*c* extend through slots in the deadlocking plate 140 and in the housing 122, thus capturing the deadlocking plate 140 between the main link carriage 128 and the housing 122 and causing the main link carriage 128 and the deadlocking plate 140 to move together. Rod 139 couples to housing flange 122*c*, and extends through a hole in flange 128*a* Compression spring 141 is telescoped over rod 139 and exerts a biasing force against flange 128*a* of main link carriage 128, thus biasing main link carriage 128 and deadlocking plate 140 toward slide 114. This position situates the center case mechanism 200 as shown in FIGS. 7*a*/*b*, with deadlocking plate 140 extended fully and deadlocking stop 114*f* on slider 114 below the deadlocking plate 140. Thus, when the center case mechanism 200 is in this position, the door is locked on the outside, i.e., the door cannot be opened from the outside and can only be opened from the inside by pushing on the push bar 106.

FIGS. 7*a*/*b*–9*a*/*b* illustrate operation of the center case mechanism 200, showing the movement of the center case mechanism 200 when the push pad actuator 106 is depressed. The "a" suffixed figures illustrate mechanism 200 from the rear showing the relationship of deadlocking plate 140 with respect to slide 114, and the "b" suffixed figures illustrate mechanism 200 from the front showing the corresponding movement of link 128 and pivoting member 116. In FIGS. 7*a*/*b*, the center case mechanism is shown in its starting, locked position, as it would appear when the push pad actuator 106 has not been depressed. Shoulder 114*d* of slider 114 is resting against stop 134 and limits the downward travel of slider 114. Deadlocking stop 114*f* on the rear side of slider 114 is below deadlocking tab 142 of the deadlocking plate 140, insuring that slider 114 is prohibited from moving upward to disengage the upper latch 210 and lower peg 206 thereby maintaining door 50 in a closed and latched position.

Figure 8A:
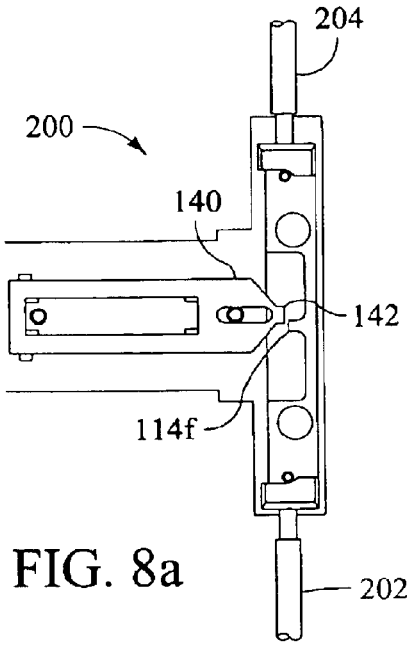
FIGS. 8*a* and 8*b* illustrate the center case mechanism from the rear and front respectively showing partial movement of the center case mechanism when the push pad actuator is depressed.
Figure 8B:
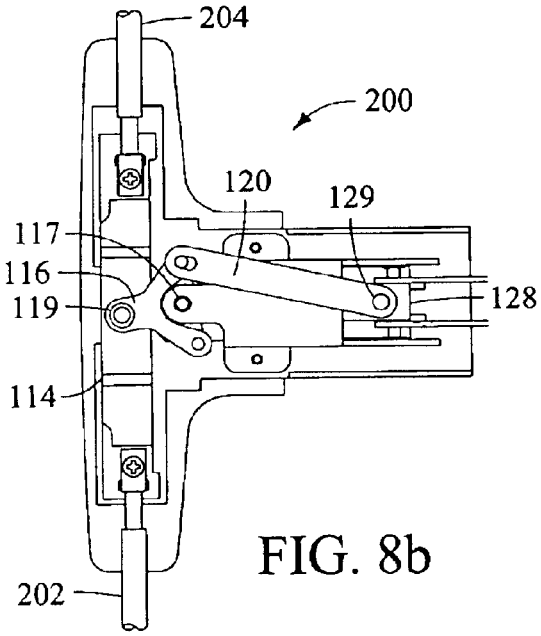

Referring now to FIGS. 8*a*/*b*, the push pad actuator 106 is partially depressed. Carriage link 128 and actuator linkage 120 are being translated to the right approximately 0.30 inch thereby causing pivoting member 116 to begin pivoting about pin 117. (Note: dimensional references herein with respect to FIGS. 7*a*/*b*–10*a*/*b* are for illustrative purposes only and can vary according to the design of a specific embodiment.) As pivoting member 116 pivots about pin 117, pin 119 is moved vertically upward and by reason of its engagement in slot 114*e* correspondingly translates slider 114 vertically upward. As carriage link 128 and deadlocking plate 140 are drawn away from slider 114, deadlocking tab 142 is horizontally withdrawn from the vertical path of deadlock stop 114*f*, thereby allowing slider 114 unobstructed vertical travel in an upwards direction causing the upward translation of vertical actuating rods 202 and 204.

Figure 9A:
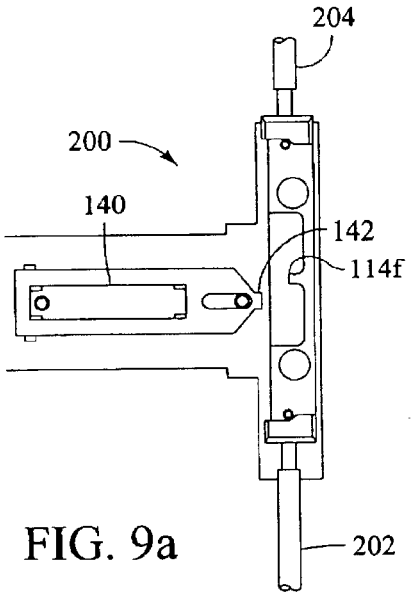
FIGS. 9*a* and 9*b* illustrate the center case mechanism from the rear and front respectively showing the panic exit device in an open and unlatched position.
Figure 9B:
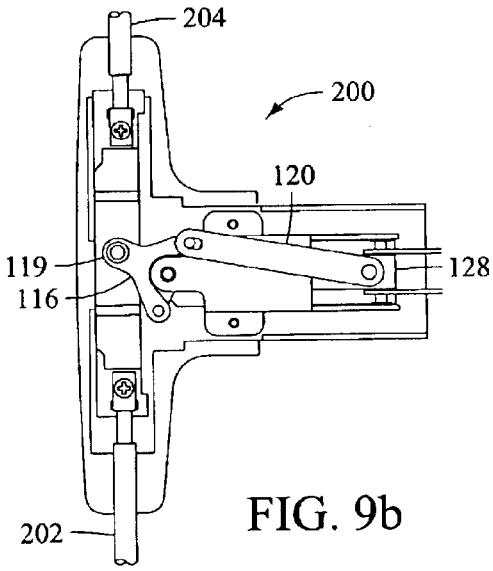

Referring now to FIGS. 9*a*/*b*, the push pad actuator 106 has been completely depressed. Carriage link 128 and deadlock plate 140 have reached their maximum translation of 0.60 inch to the right limited by compression of spring 141 and the contact of shoulder 114*c* with stop 132. Slider 114 has traveled upward its full distance of 0.767 inch. Pivoting member 116 has reached its maximum rotation about pin 117 and pin 119 has reach its maximum vertical upward travel. Actuating rods 202 and 204 have correspondingly been raised to effect unlatching of door 50 to permit door 50 to be swung open. The operation of the unlatching effected by actuating rods 202 and 204 are discussed in further detail below. Upon release of push pad actuator 106, the weight of slider 114 and rods 202 and 204 in combination with the biasing force of spring 141 automatically return center case mechanism 200 to its latched configuration as shown by FIGS. 7*a*/*b*.

Figure 10A:
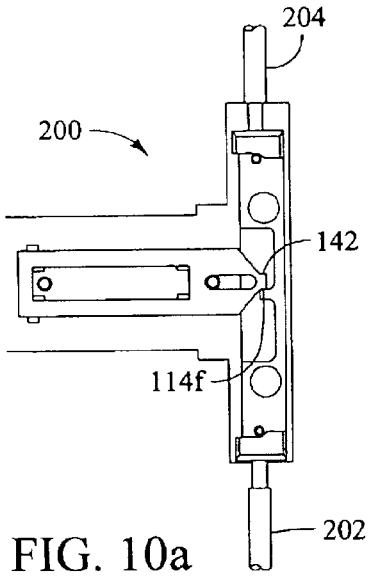
FIGS. 10*a* and 10*b* illustrate the center case mechanism from the rear and front respectively showing the engagement of the deadlock feature when the door is in a closed and latched position.

FIGS. 10*a*/*b* show the interaction of deadlock stop 114*f* and deadlock tab 142 to maintain door 50 in its latched configuration when push pad actuator 106 is not depressed. In the event that an attempt is made to vertically translate slider 114 without depressing push pad actuator 106, the door will remain latched in a "deadlock" condition. Without depressing push pad actuator 106, carriage link 128 and deadlock plate 140 remain in their leftmost position. In this position, deadlock tab 142 extends within the reach of deadlock stop 114*f*. As slider 114 is vertically raised, deadlock stop 114*f* contacts stationary deadlock tab 142. The upward movement of slider 114, wherein deadlock stop 114*f* contacts stationary deadlock tab 142, is facilitated by slot 123 in the second end of actuator linkage 120 and the movement of pin 116*a* or 116*b* therein. Slot 123 in actuator linkage 120 is required in order to permit the upward movement of slider 114 without a corresponding lateral movement of deadlock plate 140, thereby resulting in the contact of deadlock stop 114*f* with deadlock tab 142. As long as deadlock plate 140 remains stationary (no depression of push pad actuator 106), deadlock tab 142 blocks deadlock stop 114*f* and prevents the upward translation of slider 114, thus maintaining panic exit device 100 in a latched condition.

FIGS. 12 and 13*a*–13*c* illustrate the interaction of the dogging mechanism 112 with the action rod 158 and lock cylinder 112*a*. The dogging mechanism 112 is mounted to a bracket 166 that is affixed to case filler 108. The dogging mechanism 112 and bracket 166 are not coupled to the base plate 102, thus allowing the assembly to be easily removed in the factory or during installation for an alternate function such as replacement of worn parts or upgrading to new assemblies. Shims 170 can be used for height adjustments needed for different lock cylinder links on commercially available lock cylinder styles.

Figure 13A:
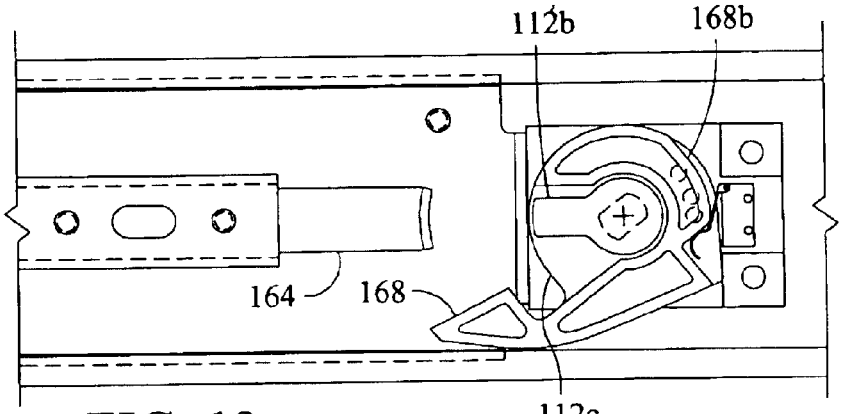
FIGS. 13*a*, 13*b*, and 13*c* illustrate the dogging mechanism, showing the interaction of the latching element within the dogging mechanism and the hook member.
Figure 13B:
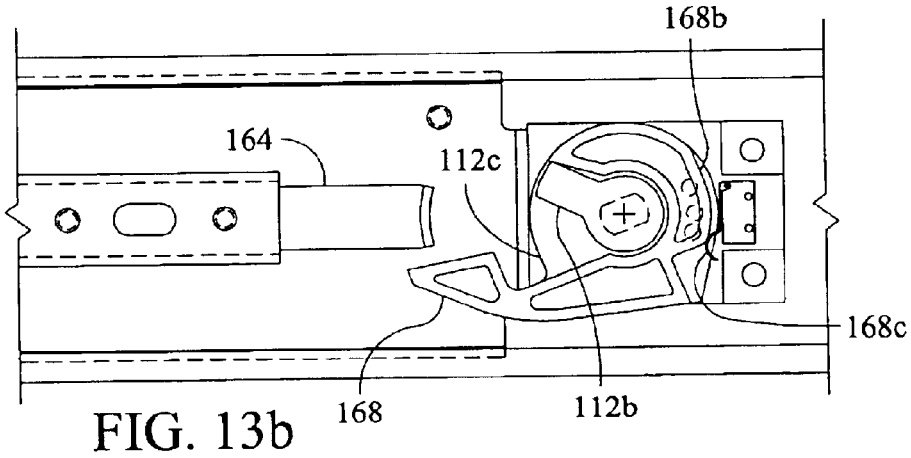
Figure 13C:
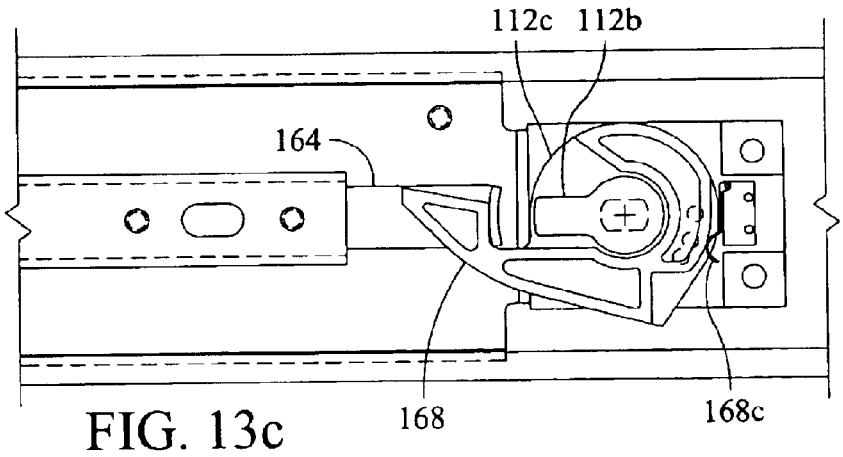

The dogging mechanism 112 comprises a latching element 168 which can engage a second hook element 164 coupled to the action rod 158. As shown in FIGS. 13*b* and 13*c*, the latching element 168 has a cam surface 168*a* Latching element 168 includes along projecting tail to prevent it from blocking the movement of action rod 158. When the latching element 168 is rotated, cam surface 168*a* engages the hook element 164 when the action rod 158 and main link carriage 128 are fully retracted, thus dogging the latch bolt into an open position. In order to rotate dogging mechanism 112, a key is inserted into lock cylinder 112*a*, shown in FIG. 12, which is coupled to tail piece 112*b* as shown in FIGS. 13*a*–13*c*. Tail piece 112*b* slides in slot 112*c* in latching element 168. As tail piece 112*b* reaches either side of slot 112*c*, it causes latching element 168 to rotate and engage or disengage the action rod 158 via the hook element 164. Slot 112*c* can be made variable widths to accommodate different rotational requirements of different commercially available lock cylinders as well as to allow the key to be rotated back to its home position for removal.

Figure 10B:
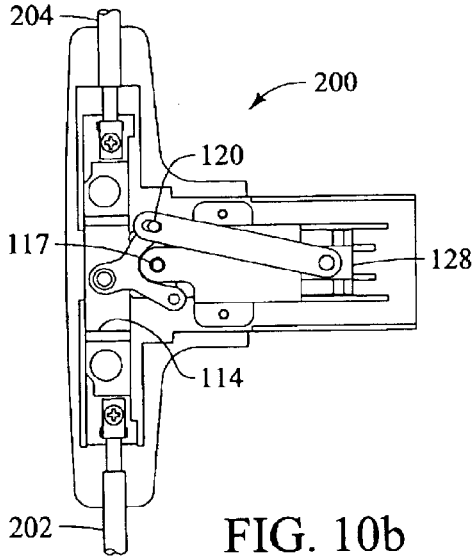

Detents 168*b* allow the dogging mechanism to be positively positioned in a variety of positions. For example, three detents are shown in FIGS. 13*a*–13*c*. The detents can serve other purposes as well. For example, when the dogging mechanism is in the second detent, as shown in FIG. 10*b*, then an electrical contact 168*c* could be made to initiate an electrical control signal, for instance, to control a security notification, solenoid or other apparatus. If a solenoid were actuated, it could possibly even retract the action bar. FIG. 10*c* illustrates the dogging mechanism seizing the hook element 164 and the action rod 158 in position.

Figure 14:
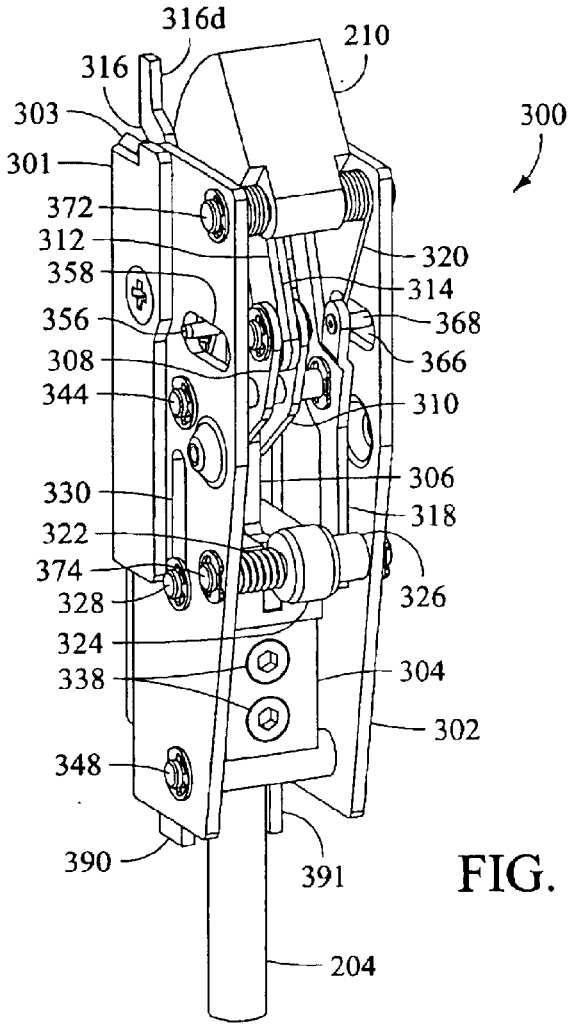
FIG. 14 is a perspective view of the upper latch mechanism and upper latch.

FIG. 14 is a perspective view of the upper latch mechanism 300 and upper latch 210. Upper latch mechanism 300 includes a mounting plate 301 (more fully described below), housing 302, an actuator rod receptacle 304, first linkage 306, a pair of pivoting linkages 308 and 310, and a pair of third linkages 312 and 314. FIG. 14 also shows two-step vertical hold arm 316, deadlocking lever 318, upper latch 210 which further includes pin 372, torsion spring 320, fire lock spring 322, fire lock bushing 324, and meltable element 326.

As shown in FIG. 14, actuator rod receptacle 304 couples to housing 302 via pin 328, which engages slots 330 and 332 (not shown) in housing 302. Actuator rod receptacle 304 receives upper vertical actuating rod 204, which is held in place by setscrews 338.

Actuator rod receptacle 302 includes slot 302*a*. As shown in FIG. 14, first linkage 306 couples at a first end to actuator rod receptacle 302 and pin 328. The second end of first linkage 306 couples to the first end of pivoting linkages 308 and 310. Pivoting linkages 308 and 310 pivot about pin 344, and couple at their second end to the first end of third linkages 312 and 314. The second ends of third linkages 312 and 314 couple to latch 210 via pin 346 (FIGS. 16*a*–*b*).

Two step vertical hold arm 316 is coupled to housing 302 by pin 348 and lock rings 350, 352, and 354. Two step vertical hold arm 316 includes pin 356, which extends through slot 358 in housing 302. Deadlocking lever 318 couples to housing 302 with pin 344. Deadlocking lever 318 further includes pin 366, which extends through slot 368 in housing 302. Torsion spring 320 biases the latch 210 in an outward, extended position, and biases two step vertical hold arm deadlocking lever 318 in an upward position by engaging pins 356 and 366. Torsion spring 320 is held in place by pins 356, 366, and 372. Pin 372 also couples latch 210 to housing 302.

Figure 15:
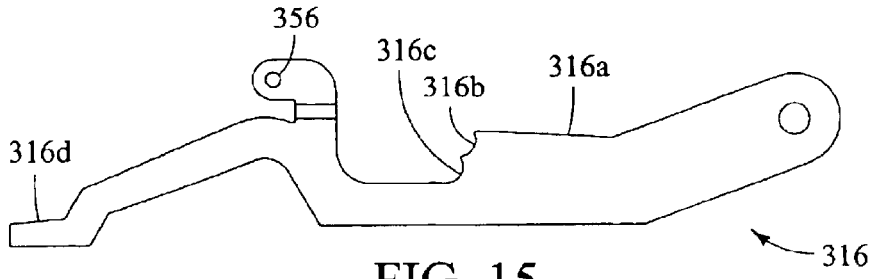
FIG. 15 shows the two step vertical hold arm within the upper latch mechanism.

FIG. 15 shows two step vertical hold arm 316 in further detail. As shown in FIG. 15, two step vertical hold arm 316 includes slide surface 316*a*, curved step 316*b*, curved step 316*c*, and lever 316*d*.

To operate the latch, when the push pad 106 is pushed, the center case mechanism 200 operates as described above to raise slider 114 and vertical actuating rod 204 approximately 0.75 inch. This raises the actuator rod receptacle 304 and first linkage 306, which in turn causes pivoting linkages 308 and 310 to pivot about pin 344 and pull back linkages 312 and 314. This action pulls back latch 210 into its fully retracted position.

Figure 16C:
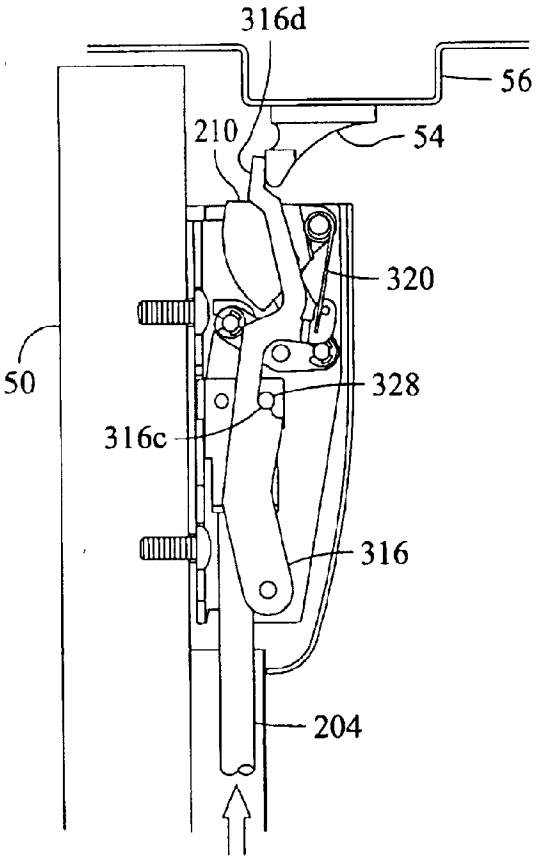
FIGS. 16*a*, 16*b*, and 16*c* show the action of the two step vertical hold arm as the actuating rod receptacle moves up and the upper latch retracts.
Figure 16B:
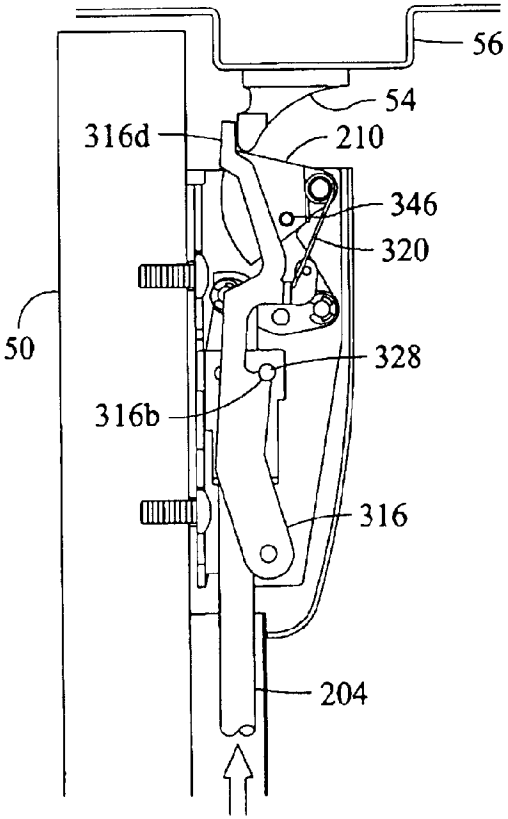
Figure 16A:
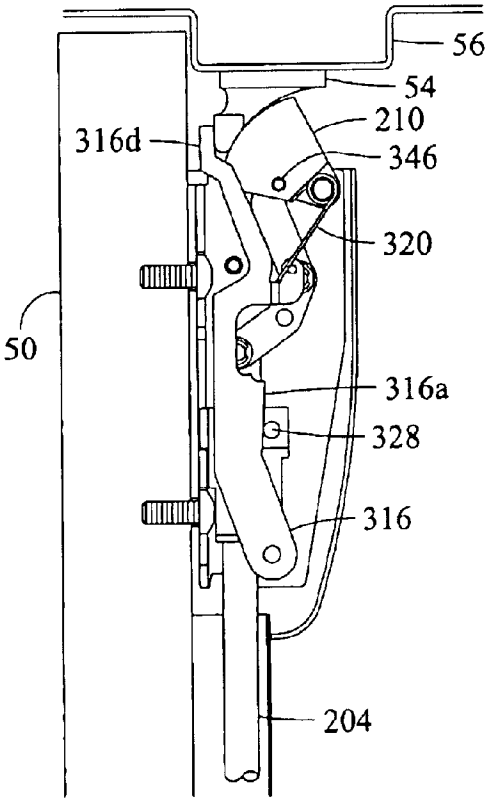

FIGS. 16*a*–16*c* show the action of the two step vertical hold arm 316 during this process. As the actuator rod receptacle 304 moves upward and operates the linkages as described above pin 328 slides along slots 330 and 332 (FIG. 14) in housing 302. Because two step vertical hold arm 316 is biased to bear against pin 328 by torsion spring 320 acting upon a bottom surface of pin 356, pin 328 slides along slide surface 316*a* of two step vertical hold arm 316. As pin 328 continues its travel along slot 330 and reaches the end of slide surface 316*a*, torsion spring 320 causes pin 328 to engage with curved step 316*b*. Similarly, as pin 328 continues upward, torsion spring 320 causes pin 328 to engage with curved step 316*c*. Two curved steps 316*b* and 316*c* are provided for improved holdback. On sagging doors, it may be possible to retract the latch and slip the door out of engagement without hitting the second step (if there were only one step). In such an incidence, the bolt 206 would re-extend while the door 50 was opening and cause damage to the flooring. At this point, actuator rod receptacle 304 is at the top of its travel and held in place by pin 328, which is: seated in curved step 316*c*. Latch 210 is fully retracted and able to clear the strike 54 in the door header 56. The door 50 can be opened and the latch 210 will be held in the retracted position until the door 50 returns to its closed position, at which time the strike 54 in the door header 56 contacts lever 316*d* and pushes it toward door 50. This action overcomes the biasing force of the torsion spring 320 upon two step vertical hold arm 316, and unseats pin 328 from curved step 316*c*. Torsion spring 320 then pushes latch 210 to its extended position, pulling back linkages 312 and 314, which in turn cause pivoting linkages 308 and 310 to pivot about pin 344 and push first linkage 306 downward, which pushes actuator rod receptacle 304 downward to its initial position.

Figure 17C:
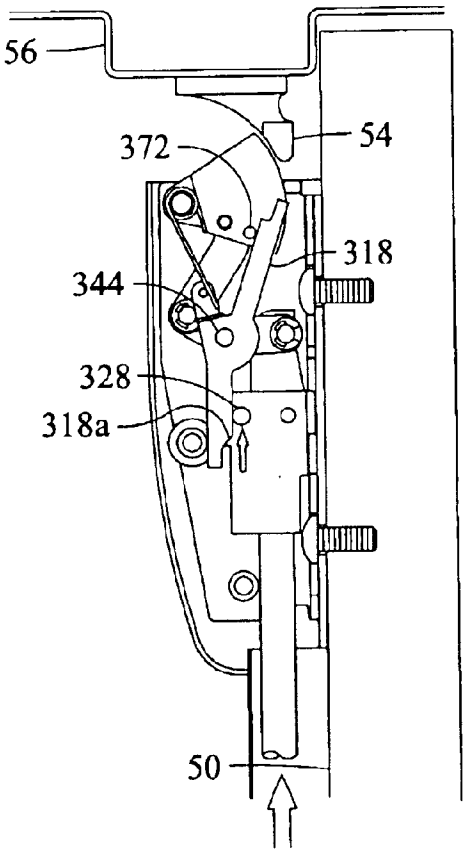
FIGS. 17*a*, 17*b*, and 17*c* show the operation of the deadlocking lever in the upper latch mechanism.
Figure 17B:
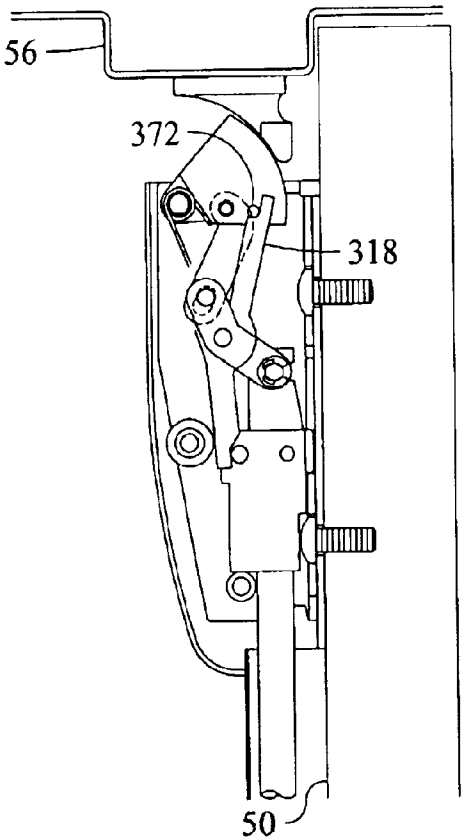
Figure 17A:
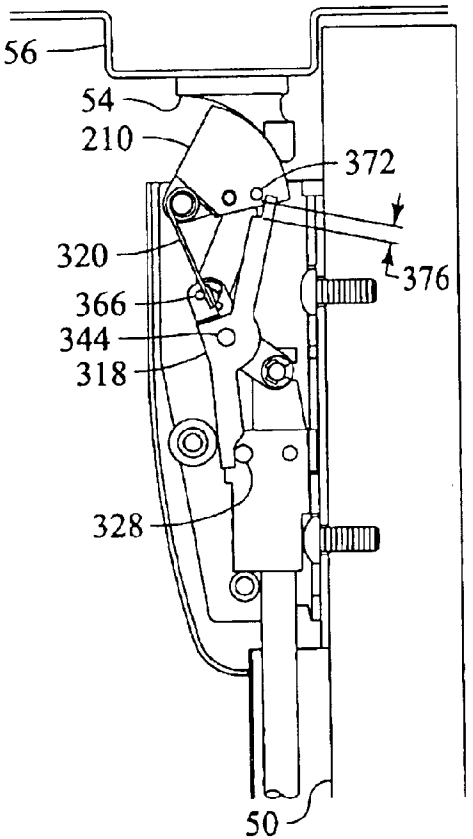

FIGS. 17*a*–17*c* show the operation of the deadlocking lever 318. When the door 50 is deadlocked, as described above, the deadlocking plate 140 in the center case mechanism 200 prevents the slider 114 from moving vertically upward. The center case mechanism 200 therefore prevents the actuator rod receptacle 304 from moving upward and thereby preventing the latch 210 from retracting. The deadlocking lever 318 operates as a fail safe mechanism, preventing the latch 210 from movement due to external forces, such as an attempt to override the deadlock by prying latch 210.

As shown in FIG. 17*a*, torsion spring 320 pushes against pin 366 to bias the deadlocking lever 318 in a counterclockwise position about pin 344. In other words, torsion spring 320 causes the deadlocking lever 318 to nearly contact pin 372 at the upper end, and to bear upon pin 328 at the lower end. When the door is deadlocked, actuator rod receptacle 304 and deadlocking lever 318 remain in their initial position. Any movement of latch 210 beyond the lost motion 376 shown in FIG. 17*a* is arrested by pin 372 coming into contact with the deadlocking lever 318, as shown in FIG. 17*b*. In normal operation, as shown in FIG. 17*c*, the actuator rod receptacle 304 rises, pushing pin 328 upwards along slot 332 (Opposite slot 330 as shown in FIG. 14). Pin 328 slides across sloped surface 318*a* of deadlocking lever 318, which causes deadlocking lever 318 to rotate clockwise about pin 344, allowing pin 372 to clear the deadlocking lever 318 as latch 210 retracts.

The deadlocking lever 318 also functions as a fire lock. Referring back to FIG. 14, fire lock spring 322, fire lock bushing 324, and meltable element 326 are coupled to housing 302 via pin 374. The outer diameter of meltable element 326 is small enough that it does not interfere with the motion of the deadlocking lever 318 in normal operation. However, in the event of a fire, the elevated temperature will melt meltable element 326. Fire lock spring 322 will then push fire lock bushing 324, which has a larger outer diameter than meltable element 326, against housing 302, above actuator rod receptacle 304. The larger outer diameter of fire lock bushing 324 prevents deadlocking lever 318 from rotating counterclockwise as described above. Pin 372 engages the deadlock lever 318 and prevents latch 210 from retracting.

Figure 19:
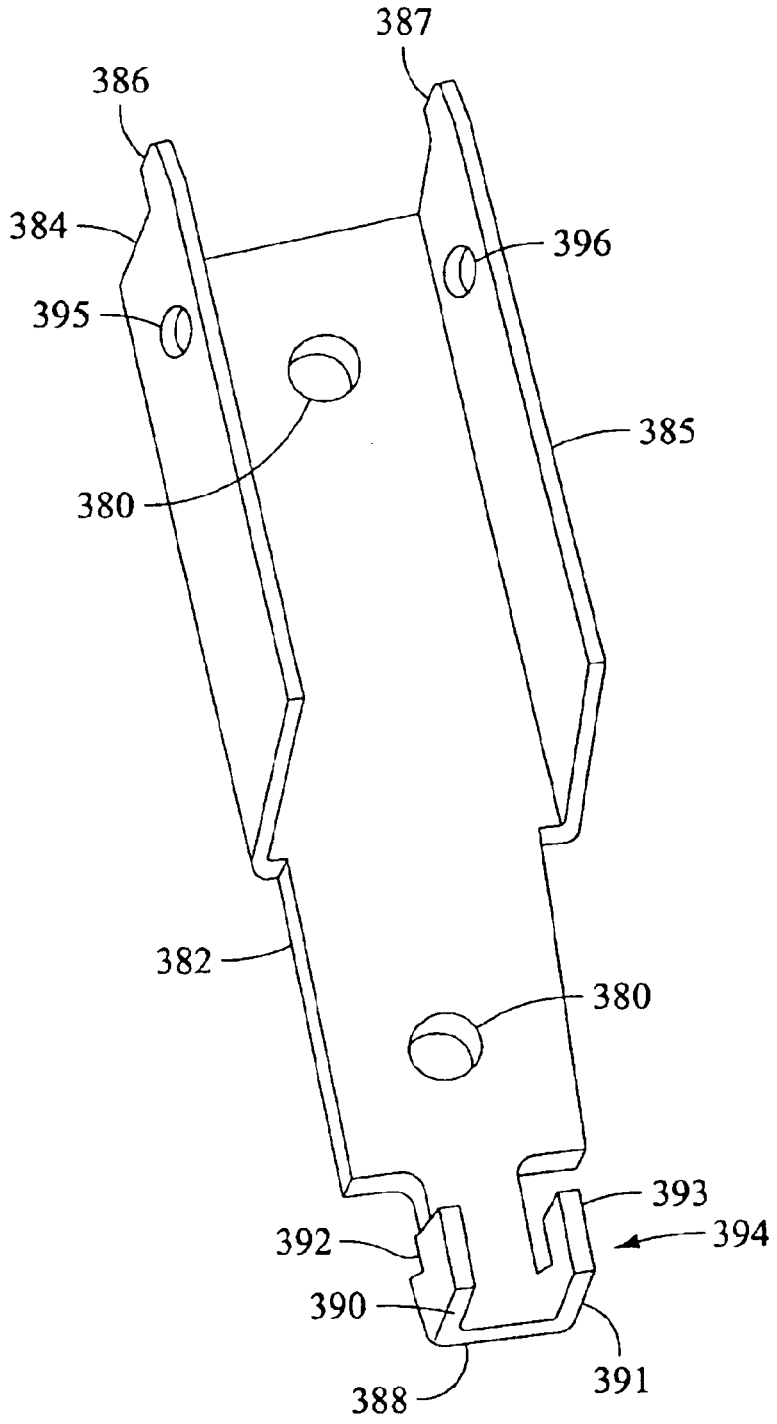
FIG. 19 is a perspective view showing the mounting plate for the upper latch mechanism.

Referring now to FIGS. 14 & 19, mounting plate 301 is used to mount upper lathing mechanism 300 to door 50. Mounting plate 301 is positioned in a desired location on door 50 by use of measurements or with a template (not shown). A template can align mounting plate 301 a predetermined distance from the edge of door 50 in both the horizontal and vertical directions. The template would provide accurate placement of upper latching mechanism 300 with respect to existing strike 254 (FIGS. 16*a*–16*c*) or to locate a combination of a new strike 254 and latch mechanism 300. A typical template would have edges to bear against the horizontal and vertical edges of the upper portion of door 50 and further include a feature to locate plate 301 with respect. thereto. Mounting plate 301 can be affixed to door 50 by fasteners inserted through holes 380 in a base 382 of plate 301. Mounting plate 301 has left and right flanges 384 and 385 respectively. Flanges 384 and 385 have upper tabs 386 and 387 extending upward from an upper end of flanges 384 and 385. Base 382 includes at a lower end, tailpiece 388 extending downwardly therefrom. Tailpiece 388 has upturned sides 390 and 391 that further include tabs 392 and 393. Tabs 392 and 393 in combination with base 382 defame horizontal slot 394.

After mounting plate 301 is attached to door 50, upper latching mechanism 300 is installed by placing mechanism 300 between flanges 384 and 385, and inserting until housing 302 contacts base 382 of mounting plate 301. Mechanism 300 is then allowed to slide down whereby the lower edge of housing 302 is captured by horizontal slot 394, and housing tabs 303 (FIG. 14) are captured by upper tabs 386 and 387 of mounting plate 301. Mechanism 300 can then be affixed to mounting plate 301 by fasteners inserted in holes 395 and 396 in flanges 384 and 385 respectively and engaging matching threaded holes in housing 302. In this manner, once the mounting plate 301 has been properly aligned on door 50, mechanism 300 can be replaced without requiring re-alignment with center case mechanism 200. To effect replacement, the attaching fasteners are removed and the old mechanism 300 is lifted out of the retaining slots in mounting plate 301 and a new mechanism is inserted and attached with like fasteners.

Figure 18B:
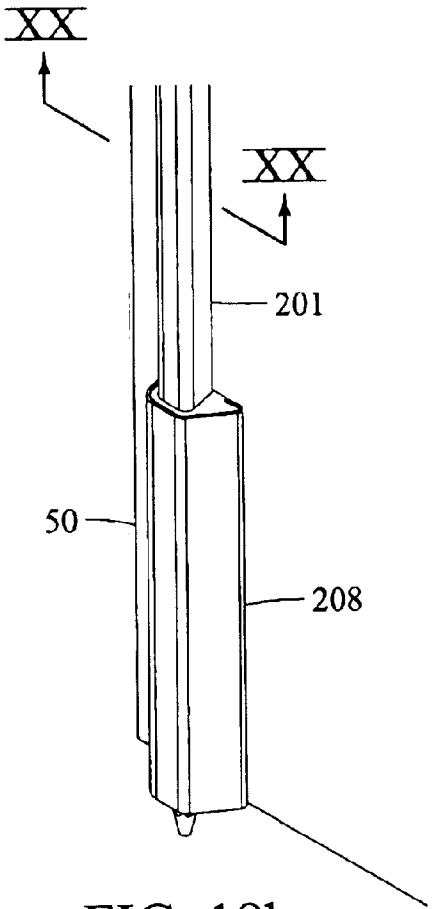
FIGS. 18*a*, and 18*b* show the interface of the lower locking pin with the lower vertical actuating rod, and the lower cover profile.
Figure 18A:
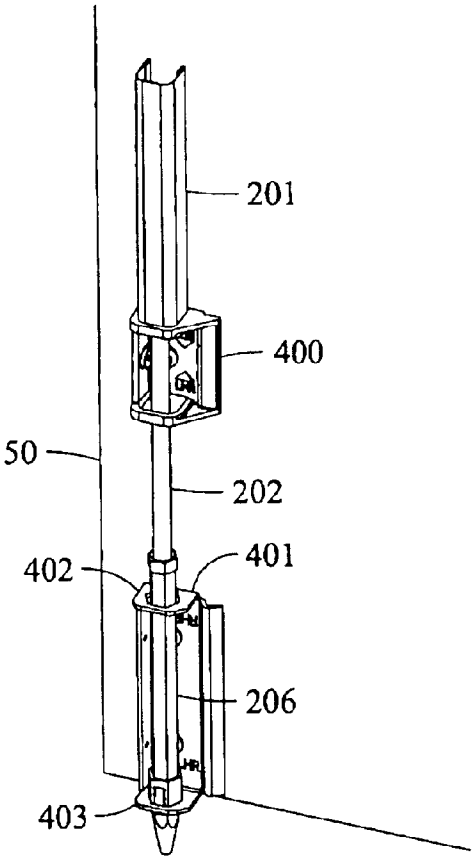

As shown in FIG. 1, upper mechanism 300, vertical actuating rods 204 and 202, and bolt 206 and its interface with vertical actuating rod 202 are protected by covers 209, 203, 201, and 208, respectively. FIGS. 18*a*–18*b* show the bottom bolt 206, its structure and interface with vertical actuating rod 202, and its cover 208. Bracket 400 mounts to the door and includes an aperture shaped to accept the lower edge of cover 201. As shown in FIG. 18*a*, vertical actuating rod 202 extends through bracket 400 and couples to bolt 206 via internal threads above bracket 401. Bolt 206 is free to slide up and down through collars 402 and 403 coupled to bracket 401.

Figure 20:
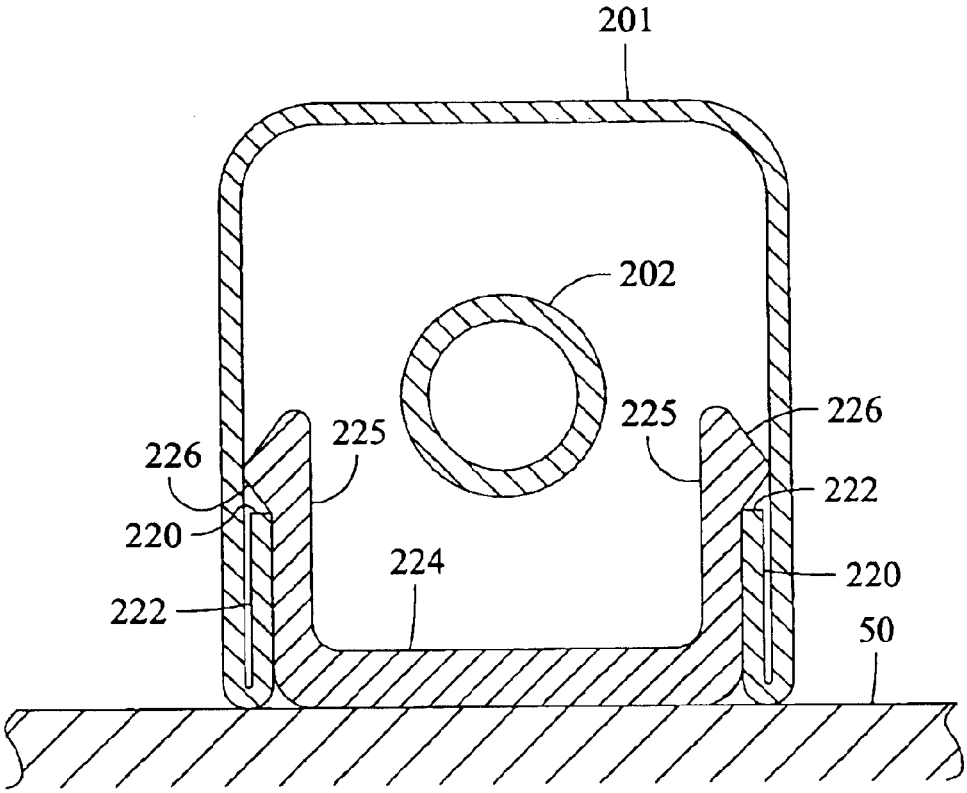
FIG. 20 is a cross-sectional view of the door and rod cover taken along the line XX—XX of FIG. 18*b*.

FIG. 18*b* shows a closeup of the transition from cover 201 to cover 208. As shown in FIG. 18*b*, cover 208 is designed to effect a gentle transition from the surface of the door to the surface of the cover, making the improved vertical panic exit device 100 fully compliant with ADA requirements. Referring also to FIG. 20, rod cover 201 includes an internal bent flange 220 on both sides of cover 201 thereby forming an internal shoulder 222. U-shaped bracket 224 having upturned flanges 225 is mounted to door 50 in vertical alignment with and behind rod 202. Flanges 225 have an external lip 226 extending longitudinally along bracket 224. Cover 201 attaches in a snap-on manner wherein the sides of cover 201 are resilient and displace around lips 226 until cover 201 is in its desired position. Shoulders 222 seat below lips 226 thereby retaining cover 201 on bracket 224. Cover 201 is thereby readily removable and does not require the use of separate fasteners. Cover 203 is attached in like manner to cover 201.

Although the best mode for carrying out the present invention has been described in the foregoing detailed description and illustrated in the accompanying drawings, it will be understood that the invention is not limited to the embodiments disclosed, but is capable of numerous rearrangements, modifications, and substitutions of steps without departing from the spirit of the invention. Accordingly, the present invention is intended to encompass such rearrangements, modifications, and substitutions of steps as fill within the scope of the appended claims.

We claim:

1. A vertical panic exit device interchangeably mountable on either left-hand opening or right-hand opening doors, comprising:

a latch mechanism for engagement with a strike mounted to a door frame to alternately transition a door mounted to the door frame between a latched and unlatched configuration;

a push bar;

an action rod interlinked to said push bar such that a depression of said push bar causes said action rod to be translated in a direction orthogonal to said push bar;

a center case mechanism movable between a latched and an unlatched position, said center case mechanism comprising:

a housing;

a main link carriage horizontally slidably mounted within said housing, said main link carriage linked to and acted upon by said action rod for translation between said latched and said unlatched position;

an actuator link having a first end pivotally attached to said main link carriage;

a pivoting member pivotally mounted to said housing, said pivoting member having first and second pivotal attach points, wherein a second end of said actuator link is selectively coupled to one of said first or second attach points, and further wherein said second end of said actuator link when selectively coupled to said first attach point configures said center case mechanism for latching and unlatching a right handed opening door, and when selectively coupled to said second attach point configures said center case mechanism for latching and unlatching a left handed opening door;

a slider vertically slidably mounted within said housing, said slider in movable engagement with said pivoting member such that a pivoting motion of said pivoting member causes said slider to slide in a vertical direction, said slider including at least one attach point for connection with said latch mechanism; and, a deadlock operatively connected between said main link carriage and said slider.

2. The vertical panic exit device according to claim 1 wherein said deadlock further comprises:

a deadlock stop linked to said slider, said deadlock stop vertically movable in concert with said vertical movement of slider, said vertical movement of said deadlock stop defining a vertical path; and a deadlock plate slidable within said housing, said deadlock plate having a first end linked to said main link carriage, and a deadlock tab extending from a second end thereof, said deadlock tab position in said vertical path when said center case mechanism is in a latched position and retracted from said path when said center case mechanism is in an unlatched position.

3. A vertical panic exit device comprising:

a push bar;

an action rod interlinked to said push bar;

a center case mechanism linked to said action rod for translation between said latched and said unlatched position;

said center case mechanism having a housing;

a slider vertically slidably mounted within said housing;

said slider having a deadlock stop vertically movable with said slider, said vertical movement of said deadlock stop defining a vertical path; and a deadlock plate slidable within said housing, said deadlock plate positioned in said vertical path when said center case mechanism is in a latched position and retracted from said path when said center case mechanism is in an unlatched position.

4. The vertical panic exit device according to claim 2, wherein said second end of said actuator link has a limited free travel with resect to said attach point of said pivoting member such that a vertical movement of said slider results in a pivoting of said pivoting member and a corresponding movement of said attach point with respect to said actuator link, but induces on corresponding movement of said actuator link.

5. The vertical panic exit device according to claim 4 wherein said actuator link has a slot at said second end and said attach point of said pivoting member is a pin engaged in said slot.

6. The vertical panic exit device according to claim 3 wherein said deadlock stop is attached to said slider.

7. The vertical panic exit device according to claim 1 wherein said latch mechanism is remote from said center case mechanism, and further including:

an actuator rod extending between said slider and said latch mechanism, such that said vertical movement of said slider causes a like movement of said actuator rod and a latching and unlatching of said latching mechanism.

8. The vertical panic exit device according to claim 7 including a second latching mechanism, said second latching mechanism comprising: an actuating rod extending vertically below said center case mechanism, and attached to said slider at one end thereof; and a bolt at a second end thereof, said bolt selectively locatable to extend below the lower edge of a door when said center case mechanism is in a latched position, and retracted at least to the lower edge of the door when said center case mechanism is in an unlatched position.

9. The vertical panic exit device according to claim 7 wherein said latching mechanism is positioned at an upper edge of the door.

10. The vertical panic exit device according to claim 9 wherein said latching mechanism comprises:

a housing;

a latch pivotally mounted to said housing and pivotable between an extended latched position for engagement with the doorjamb mounted strike, and a retracted position for opening the door;

an actuator rod receptacle slidably retained in said housing; and a linkage interconnecting said latch and said receptacle, said linkage translating an upward movement of said actuator rod receptacle to a downward retracted pivoting of said latch.

11. The vertical panic exit device according to claim 10 wherein said latching mechanism further includes a holding mechanism.

12. The vertical panic exit device according to claim 11 wherein said holding mechanism comprises:

a holding pin extending from a side of said actuator rod receptacle;

a holding arm pivotally coupled to said housing, and partially bearing against said holding pin, said holding arm defining at least one step; and a biasing spring biasing said holding arm against said holding pin; such that an upward movement of said actuator rod receptacle translates said holding pin to an engagement position with said at least one step, said engagement position corresponding to a retracted position of said latch, and said biasing spring pivoting said holding arm to engage said holding pin in said step, thereby retaining said latch in a retracted unlatched position.

13. The vertical panic exit device awarding to claim 12, wherein said holding arm further includes a strike lever extending upward from said housing, such that closure of the door results in said strike lever contacting the doorjamb mounted strike and such contact causing the disengagement of said holding pin from said step.

14. The vertical panic exit device according to claim 11 wherein said holding arm defines two adjacent steps for the sequential engagement of said holding pin as said actuator rod receptacle is translated vertically upward.

15. The vertical panic exit device according to claim 7 wherein said latching mechanism further includes a deadlock.

16. The vertical panic exit device according to claim 15 wherein said latching mechanism deadlock comprises:

a deadlock arm pivotally mounted to said housing, said deadlock arm having a ramp surface at a first end and defining a step at a second end;

a deadlock latch pin extending from said latch;

a biasing spring biasing said step toward said deadlock latch pin to engage said deadlock latch pin in said step to prevent retraction of said latch when said latch mechanism and said actuator rod receptacle are in said latched position; and an actuator pin extending from said actuator rod receptacle slidably engaging said ramp surface such that vertical movement of said actuator rod receptacle causes pivoting of said deadlock arm and removal of said step from a path of said deadlock latch pin thereby permitting retraction of said latch to an unlatched position.

17. The vertical panic exit device according to claim 9 wherein said latching mechanism includes a mounting plate mounting said latching mechanism to the door.

18. The vertical panic exit device according to claim 17 wherein:

said housing includes at an upper end thereof outwardly extending tabs; and said mounting plate comprises a U-shaped receptacle having upper tabs wherein said upper tabs capture said outwardly extending tabs of said housing; and a tail portion having lower tabs, said lower tabs defining at least a portion of a horizontal slot wherein said horizontal slot captures a bottom edge of said housing.

19. A center case mechanism for a vertical panic exit device that is operable between a latched and an unlatched position, said center case mechanism comprising:

a housing;

a main link carriage horizontally slidably mounted within said housing, said main link carriage translatable between said latched and said unlatched position;

an actuator link having a first end pivotally attached to said main link carriage;

a pivoting member pivotally mounted to said housing, said pivoting member having first and second pivotal attach points, wherein a second end of said actuator link is selectively coupled to one of said first or second attach points, and further wherein said second end of said acuator link when selectively coupled to said first attach point configures said center case mechanism for latching and unlatching a right handed opening door, and when selectively coupled to said second attach point configures said center case mechanism for latching and unlatching a left handed opening door;

a slider vertically slidably mounted within said housing, said slider in movable engagement with said pivoting member such that a pivoting motion of said pivoting member causes said slider to slide in a vertical direction, said slider including at least one attach point for connection with a latch mechanism; and, a deadlock operatively connected between said main carriage and said slider.

20. The center case mechanism according to claim 19 wherein said attach points on said pivoting member are pins.

21. The center case mechanism according to claim 20 wherein said said deadlock further comprises:

a deadlock stop linked to said slider, said deadlock stop vertically movable in concert with said vertical movement of said slider, said vertical movement of said deadlock stop defining a vertical path; and a deadlock plate slidable within said housing, said deadlock plate having a first end linked to said main link carriage, and a deadlock tab extending from a second end thereof, said deadlock tab positioned in said vertical path when said center case mechanism is in a latched position and retracted from said path when said center case mechanism is in an unlatched position.

22. The center case mechanism according to claim 21, wherein said second end of said actuator link has a limited free travel with respect to said attach point of said pivoting member such that a vertical movement of said slider results in a pivoting of said pivoting member and a corresponding movement of said attach point with respect to said actuator link, but induces no corresponding movement of said actuator link.

23. The center case mechanism according to claim 22 wherein said actuator link has a slot at said second end and said attach point of said pivoting member is a pin engaged in said slot.

24. The center case mechanism according to claim 20 wherein said deadlock stop is attached to said slider.

25. An upper latching mechanism for a vertical panic exit device, said latching mechanism comprising:

a housing;

a latch pivotally mounted to said housing and pivotable between an extended latched position for engagement with the doorjamb mounted strike, and a retracted position for opening the door;

an actuator rod receptacle slidably retained in said housing; and a linkage interconnecting said latch and said receptacle, said linkage translating an upward movement of said actuator rod receptacle to a downward retracted pivoting of said latch; and, a holding mechanism comprising;

a holding pin extending from a side of said actuator rod receptacle;

a holding arm pivotally coupled to said housing, and partially bearing against said holding pin, said holding arm defining at least one step; and, a biasing spring biasing said holding arm against said holding pin; such that an upward movement of said actuator rod receptacle translates said holding pin to an engagement position with said at least one step, said engagement position corresponding to a retracted position of said latch, and said biasing spring pivoting said holding arm to engage said holding pin in said step, thereby retaining said latch in a retracted unlatched position.

26. The upper latching mechanism according to claim 25, wherein said holding arm further includes a strike lever extending upward from said housing, such that closure of the door results in said strike lever contacting the doorjamb mounted strike and such contact causing the disengagement of said holding pin from said step.

27. The upper lathing mechanism according to claim 25 wherein said holding arm defines two adjacent steps for the sequential engagement of said holding pin as said actuator rod receptacle is translated vertically upward.

28. An upper latching mechanism for a vertical panic exit device, said latching mechanism comprising:

a housing;

a latch pivotally mounted to said housing and pivotable between an extended latched position for engagement with the doorjamb mounted strike, and a retraced position for opening the door;

an actuator rod receptacle slidably retained in said housing;

a linkage interconnecting said latch and said receptacle, said linkage translating an upward movement of said actuator rod receptacle to a downward retracted pivoting of said latch; and, a deadlock comprising;

a deadlock arm pivotally mounted to said housing, said deadlock arm having a ramp surface at a first end and defining a step at a second end;

a deadlock latch pin extending from said latch;

a biasing spring biasing said step toward said deadlock latch pin to engage said deadlock latch pin in said step to prevent retraction of said latch when said latch mechanism and said actuator rod receptacle are in said latched position; and an actuator pin extending from said actuator rod receptacle slidably engaging said ramp surface such that vertical movement of said actuator rod receptacle causes pivoting of said deadlock arm and removal of said step from a path of said deadlock latch pin thereby permitting retraction of said latch to an unlatched position.

29. The upper latching mechanism according to claim 25 wherein said biasing spring engages said latch to bias said latch in the extended latched position.

30. The upper latching mechanism according to claim 29 wherein said biasing spring engages a deadlock pin so as to prevent retraction of said latch when said latch mechanism and said actuator rod receptacle are in said latched position.

31. The upper latching mechanism according to claim 28 wherein said biasing spring engages said latch to bias said latch in the extended latched position.

32. The upper latching mechanism according to claim 31 wherein said biasing spring engages a holding mechanism so as to retain said latch in a retracted unlatched position.

* * * * *